US006861594B2

(12) United States Patent
Sadowski et al.

(10) Patent No.: US 6,861,594 B2
(45) **Date of Patent: *Mar. 1, 2005**

(54) ELECTRIC SWITCH HAVING BOTH TOGGLE AND ROCKER FUNCTIONS

(75) Inventors: Walter Sadowski, Newington, CT (US); Rick Olson, Newington, CT (US); Shakib Saria, Glastonbury, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/639,887

(22) Filed: Aug. 13, 2003

(65) Prior Publication Data

US 2004/0149557 A1 Aug. 5, 2004

Related U.S. Application Data

(63) Continuation of application No. 10/354,889, filed on Jan. 30, 2003, now Pat. No. 6,713,693.

(51) Int. Cl.[7] ..... H01H 9/00
(52) U.S. Cl. ..... 200/5 R; 200/18; 200/17 R
(58) Field of Search ..... 200/4, 5 R, 16 R, 200/17 R, 18, 339

(56) References Cited

U.S. PATENT DOCUMENTS 4,242,551 A 12/1980 Sorenson
4,268,734 A 5/1981 Sorenson
4,340,791 A 7/1982 Sorenson
5,451,729 A * 9/1995 Onderka et al. ..... 200/18
5,508,479 A * 4/1996 Schooley ..... 200/5 R
5,952,628 A * 9/1999 Sato et al. ..... 200/4
5,952,631 A * 9/1999 Miyaki ..... 200/6 A
6,246,019 B1 * 6/2001 Nakamura et al. ..... 200/6 A

* cited by examiner

*Primary Examiner*—Lincoln Donovan
*Assistant Examiner*—Kyung Lee
(74) *Attorney, Agent, or Firm*—McCormick, Paulding & Huber LLP

(57) ABSTRACT

A switch having independently operable toggle and rocker functions. The switch having a housing, a toggle member pivotally mounted in the housing, the toggle member having upper and lower portions. The upper portion being movable for providing a toggle function of the switch, the lower portion being attached to the upper portion and having at least one first contact element coupled thereto. The switch having a rocker member coupled to the housing for providing a rocker function, the rocker member defining a central opening for receiving the upper portion of the toggle member, and having a second contact element coupled thereto. The switch including a circuit board inside the housing having a first conductive portion adjacent the first contact element, and a second conductive portion adjacent the second contact element. The toggle and rocker members being independently operable for providing toggle and rocker functions of the switch respectively.

20 Claims, 10 Drawing Sheets

ELECTRIC SWITCH HAVING BOTH TOGGLE AND ROCKER FUNCTIONS

CROSS REFERENCE TO RELATED APPLICATIONS

This application is a continuation of application of a prior application Ser. No. 10/354,889 filed on Jan. 30, 2003 now U.S. Pat. No. 6,713,693 entitled "Electric Switch Having Both Toggle and Rocker Functions", which is incorporated herein by reference.

FIELD OF THE INVENTION

The present invention relates generally to electric switches and in particular to an electric switch providing independently operable toggle and rocker functions.

SUMMARY OF THE INVENTION

The present invention provides an electric switch having both toggle and rocker functions that are independently operable. The switch includes a toggle member pivotally coupled to a housing, the toggle member having an upper portion positionable for operating a toggle function of the switch and a lower portion having a first contact element coupled thereto. A rocker member is also coupled to the housing for operating a rocker function of the switch. The switch housing is preferably formed from a dielectric thermoplastic material such as nylon, however other materials could be utilized as well. The rocker member defines a central opening and has a second contact element coupled thereto. The upper portion of the toggle member extends through the opening in the rocker member. A circuit board is attached interior the housing and disposed parallel to the plane of pivotal motion of the toggle member. The circuit board has a first conductive portion disposed adjacent the first contact element so that the first contact element is connectable with the first conductive portion in various configurations providing the toggle function of the switch. A second conductive portion is disposed on the circuit board adjacent the second contact element for providing the rocker function of the switch.

In a preferred embodiment, the switch includes a flexible portion covering the central opening defined by the rocker member and sealed about the upper portion of the toggle member. The flexible portion can provide a seal to protect the switch from contaminants or the environment. Preferably, the flexible portion is manufactured from an elastomeric material such as rubber. Additionally, the switch can include LEDs or other devices to illuminate various portions of the switch. In one embodiment the rocker member 16 is translucent and includes an LED such that the rocker member itself is illuminated.

DETAILED DESCRIPTION

Figure 1:
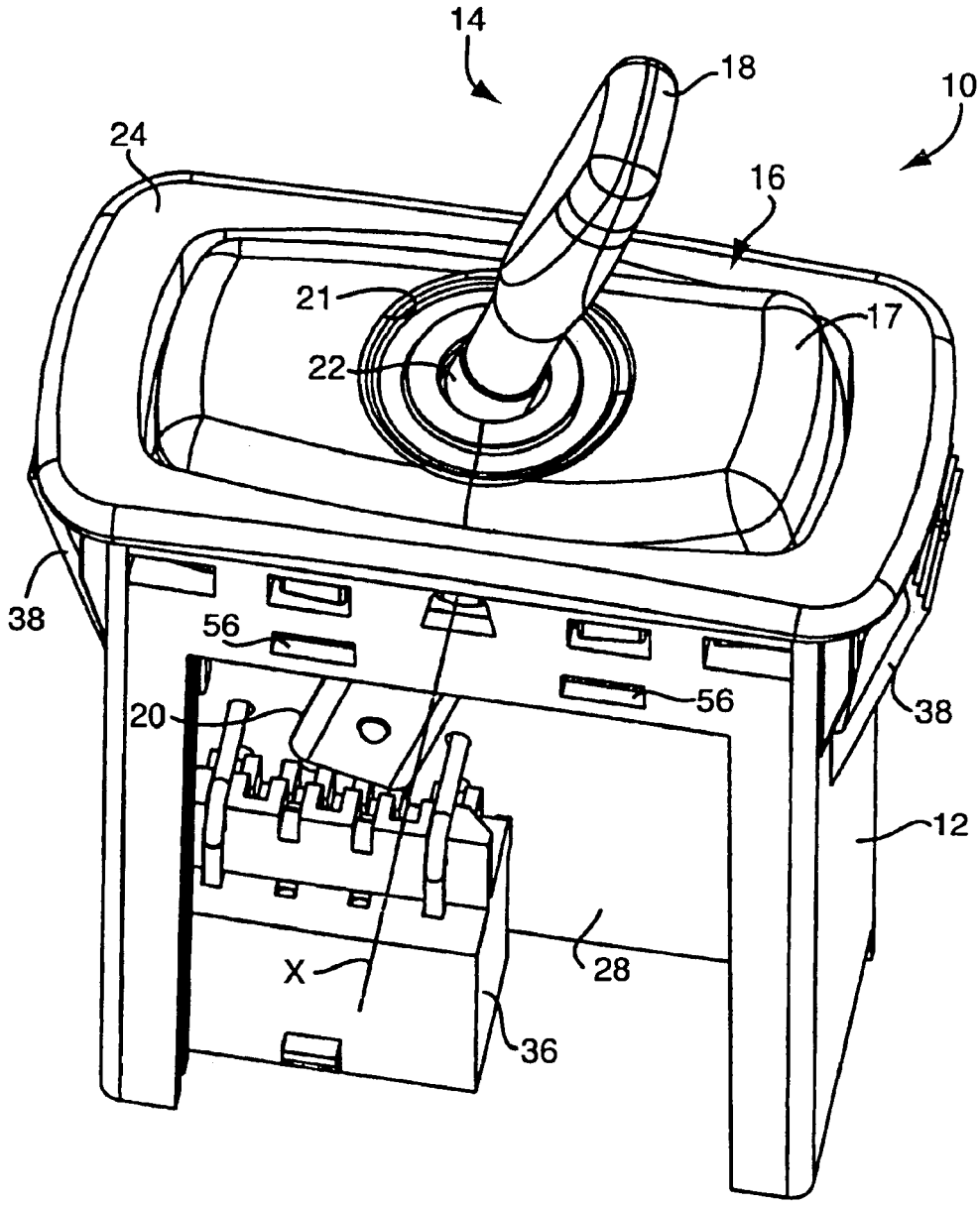
FIG. 1 is a perspective view of one embodiment of a switch according to the present invention shown without the bottom and side panels thereof.
Figure 2:
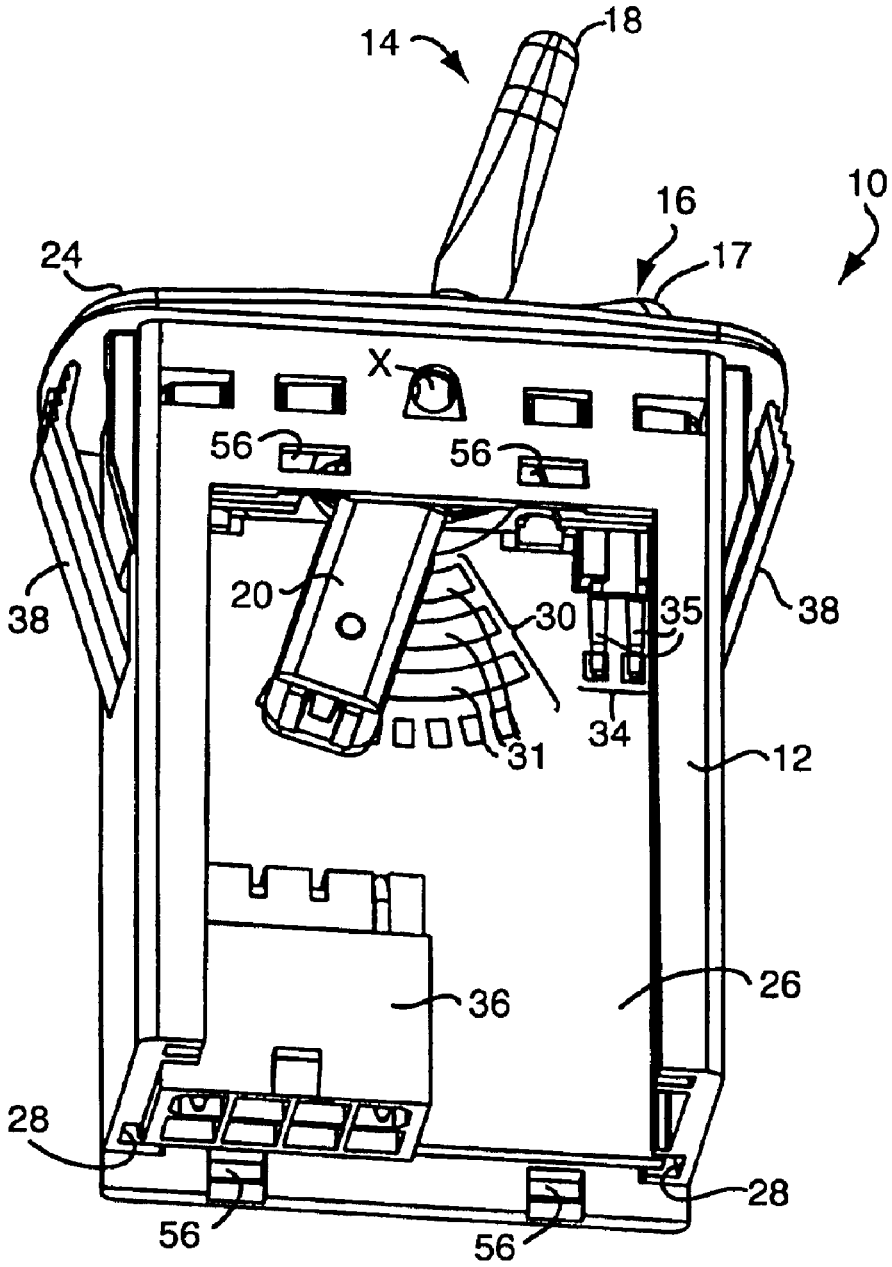
FIG. 2 is a perspective view of the switch shown in FIG. 1.

Referring to the drawings, FIG. 1 shows a switch according to the present invention, referred to generally by the reference numeral 10. The switch 10 has a housing 12, a toggle member generally referred to by the reference numeral 14, and a rocker member generally referred to by the reference numeral 16. The toggle member 14 is pivotally coupled to the housing 12 about an axis X, such that an upper portion 18 of the toggle member extends on one side of the X axis generally exterior of the housing 12 for manual control of the toggle function of the switch 10. A lower portion, generally 20, of the toggle member 14 is attached to the upper portion 18 and extends interior the housing 12 on an opposing side of the axis X. The switch 10 has a housing 12 that has removable side and bottom panels. FIGS. 1 and 2 show the housing 12 without these panels.

The rocker member 16 is also coupled to the housing for motion relative thereto for manual operation of a rocker function of the switch 10. The rocker member 16 defines a central opening 21 through which the upper portion 18 of the toggle member 14 extends and is operable. The rocker member 16 has a flexible portion 22 that covers the central opening 21 and is sealed about the upper portion 18 of the toggle member 14 to protect the switch 10 from the environment. Preferably, the flexible portion 22 is manufactured from an elastomeric material such as rubber. A bezel 24 surrounds both the toggle member 14 and the rocker member 16 of the switch 10. In the preferred embodiment, an actuator portion 17 of the rocker member 16 is manufactured from a resiliently deformable elastomeric material and the flexible portion 22 is formed integral therewith.

Referring to FIG. 2, the switch 10 includes a circuit board 26 coupled to the housing 12 parallel to the plane of pivotal motion of the toggle member 14. In the embodiment shown, the circuit board 26 is slideably engaged in the slots 28 provided in the housing 12. The circuit board 26 has a first conductive portion 30 that is disposed adjacent the lower portion 20 of the toggle member 14 for selective electrical connection with first contact elements 32 (shown in FIG. 4). The contact elements 32 are carried by a lever 33 attached to the lower portion 20 of the toggle member 14 and spring biased via a spring 45 to ensure an electrical connection between the contact elements 32 and the first conductive portion 30. The contact elements 32 are biased normally to the plane of pivotal motion of the toggle member 14. In the embodiment shown, the contact elements 32 are dumbbell-shaped and arranged to provide an electrical connection between one or more portions of the first conductive portion 30 on the circuit board 26 depending on the selected position of the upper portion 18 of the toggle member 14. As shown in FIG. 2, the first conductive portion 30 defines a plurality of radially spaced arcuate contacts 31 on said circuit board.

Still referring to FIG. 2, the circuit board 26 has a second conductive portion 34 disposed adjacent second contact elements 35 that cooperate to provide, in part, the rocker function of the switch 10. A coupler 36 is connected to the circuit board 26 and connects the first and second conductive portions of the circuit board, 30 and 34 respectively, to a wiring harness (not shown). A pair of flexible wing members 38 are attached to the housing 12 for mounting the switch 10 in a control panel (not shown) of a vehicle or other apparatus.

Figure 3:
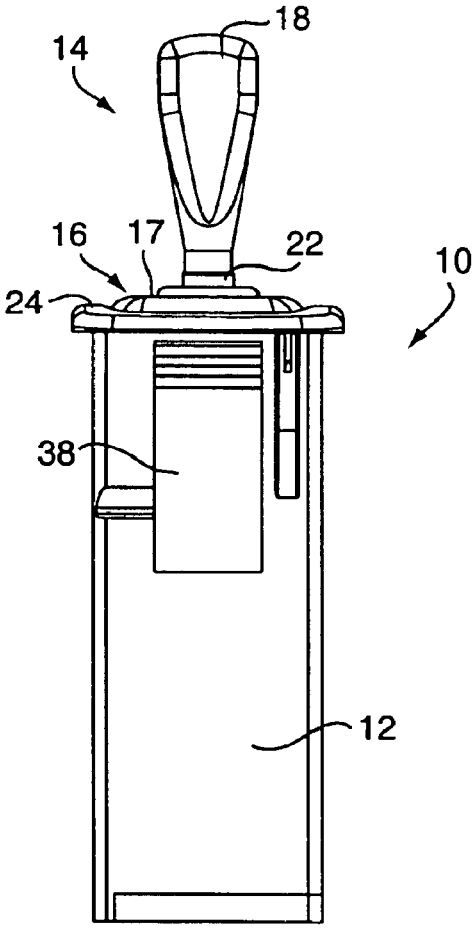
FIG. 3 is an elevational view of an end of the FIG. 1 switch.
Figure 4:
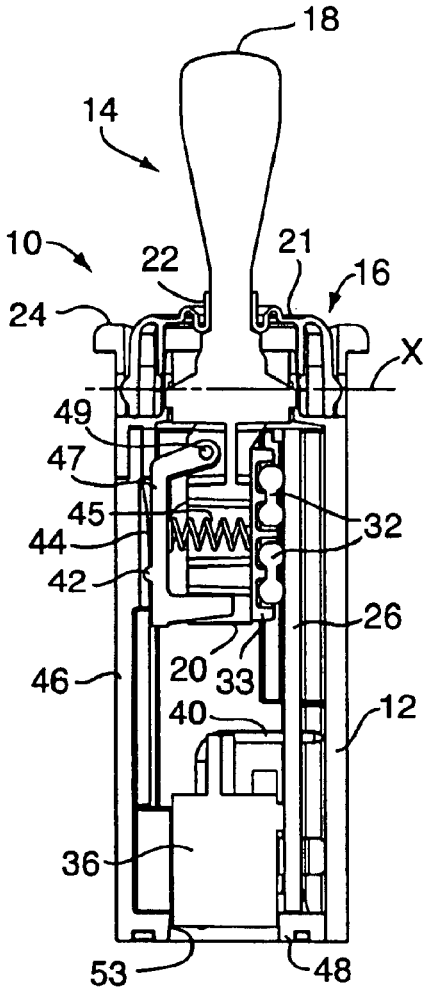
FIG. 4 is a cut-away view of the switch of FIG. 3.

Referring to FIGS. 3 and 4, the switch 10 is shown in elevational end views wherein FIG. 4 is a cut-away view of the switch of FIG. 3 that shows the interior area of the switch defined by the housing 12. FIGS. 3 and 4 show the switch 10 with the side panel 46 and the bottom panel 48 of the housing 12 attached thereto. Referring to FIG. 4, the lower portion 20 of the toggle member 14 is shown having the dumbbell-shaped contact elements 32 disposed in the lever 33 and adjacent the circuit board 26. The coupler is connected to the circuit board 26 via a plurality of pins 40. A shoulder or detent 42 is attached to a hinged member 47 of the lower portion 20 of the toggle member 14. The hinged member 47 is pivotable about a hinge pin 49 and cooperates with an incremental detent 44 on the side panel 46 of the housing 12 to secure the selected position of the toggle member 14 of the switch 10. A spring 45 operates between the hinged member 47 and the lever 33 and biases the detent 42 against the incremental detent 44 and provides a force for electrically connecting the first contact elements 32 with the first conductive portion 30 of the circuit board 26. Alternatively, the hinged member 47 and lever 33 could include one or more plastic hinges eliminating the need for the spring 45.

Figure 5:
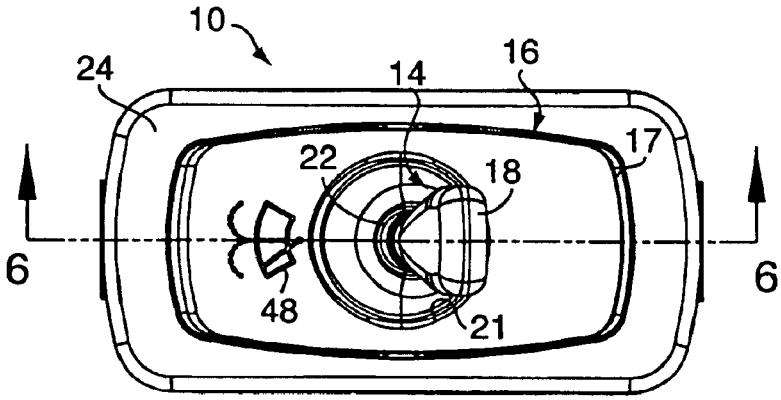
FIG. 5 is a top plan of the FIG. 1 switch.

Referring to FIG. 5, the switch 10 is shown having indicia 48 on the rocker member 16 indicating the function of the switch. The switch 10, shown in FIG. 5 is configured for use in a vehicle wherein the windshield wipers are operated using the toggle function of the switch and a windshield washer pump is controlled using the rocker function of the switch. In other applications, the switch 10 can be used to control other devices or functions thereof.

Figure 6:
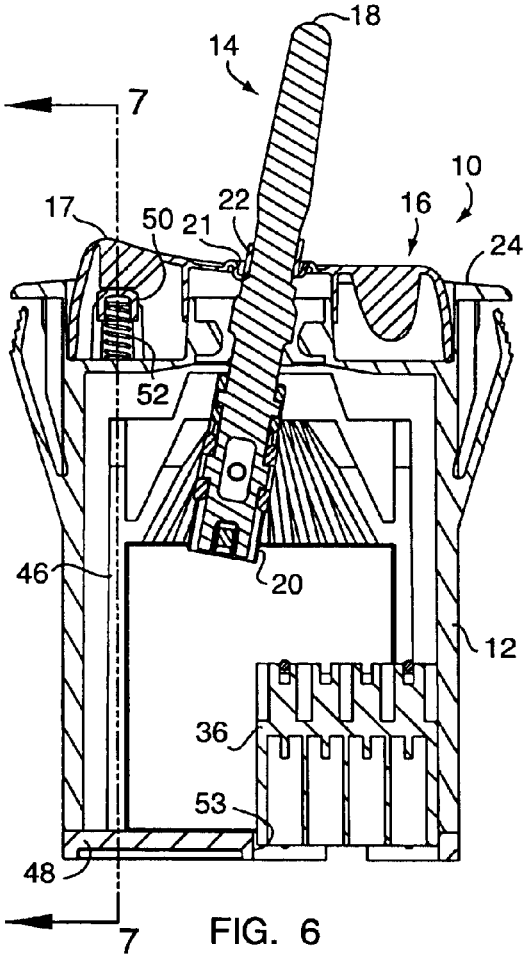
FIG. 6 is sectional view of the FIG. 1 switch taken generally at the line A—A identified in FIG. 5.
Figure 7:
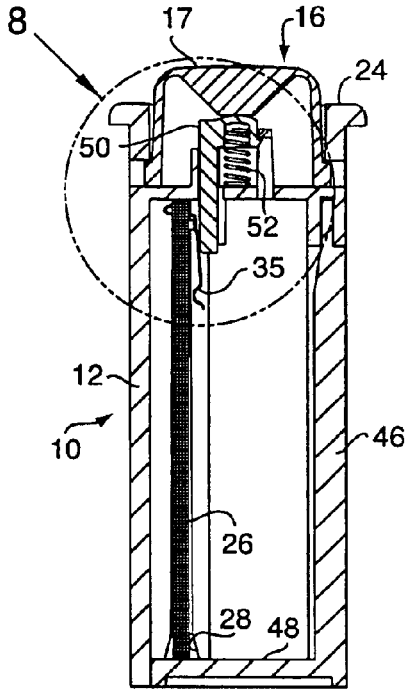
FIG. 7 is a sectional view of the FIG. 1 switch taken generally at the line C—C identified in FIG. 6.
Figure 8:
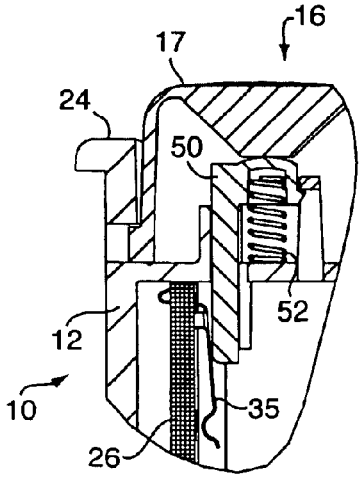
FIG. 8 is a detailed view of the area D identified in FIG. 7.
Figure 9:
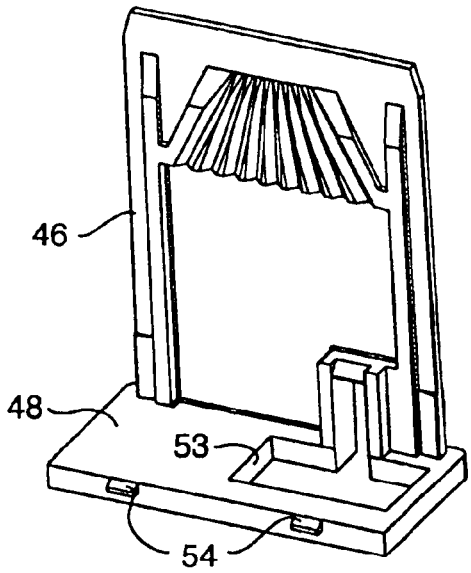
FIG. 9 is a perspective view of the bottom and side panels of the housing of the FIG. 1 switch.
Figure 10:
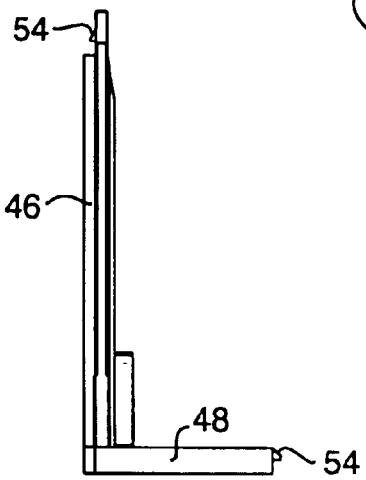
FIG. 10 is a left side elevational view of the housing panels shown in FIG. 9.
Figure 12:
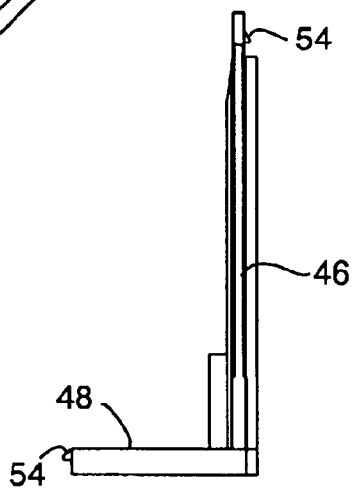
FIG. 12 is a right side elevational view of the housing panels shown in FIG. 9.
Figure 11:
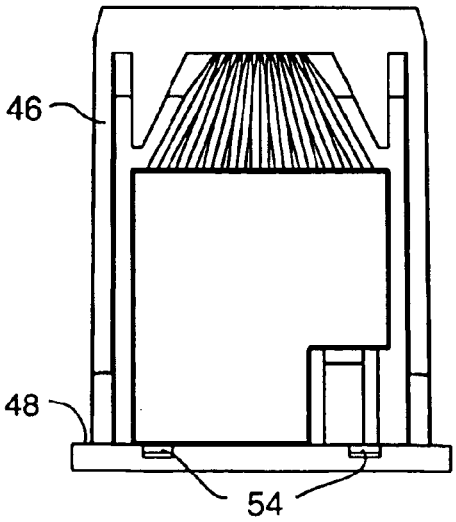
FIG. 11 is a front side elevational view of the housing panels shown in FIG. 9.

FIGS. 6–8 show details of the rocker function of the switch 10. The actuator portion 17 of the rocker member 16 is positioned adjacent to plunger 50. A compression spring 52 biases the plunger against the rocker member 16. In the preferred embodiment, the rocker switch is a momentary contact switch, wherein the second contact elements 35 make contact with the second conductive portion 34 of the circuit board 26 only when the actuator portion 17 is depressed. In other embodiments of the present invention, the rocker member 16 of the switch 10 includes an actuator portion 17 at either end thereof. Accordingly, the rocker member 16 could be configured to function as an on/off switch wherein depressing one end of the rocker member 16 closes the switch and depressing an opposing end of the rocker member 16 opens the switch. Alternatively, the rocker function of the switch 10 can be configured to function as an on/off switch wherein repeatedly depressing one end of the rocker member 16 functions to both open and close the switch. However, the present invention is not limited in this regard as both the toggle and rocker functions of the switch 10 can be configured in numerous known methods, depending on the application, and not depart from the scope and spirit of the invention.

Referring to FIGS. 9–12, the removable side panel 46 and bottom panel 48 of the housing 12 are shown in various views thereof. The bottom panel 48 defines an opening 52 aligned with the coupler 36 so that a cooperating connector on a wiring harness (not shown) can be connected to the coupler 36.

Tabs 54 are disposed on the removable panels 46 and 48 to couple the panels to the housing 12 via cooperating openings 56 therein.

Figure 13:
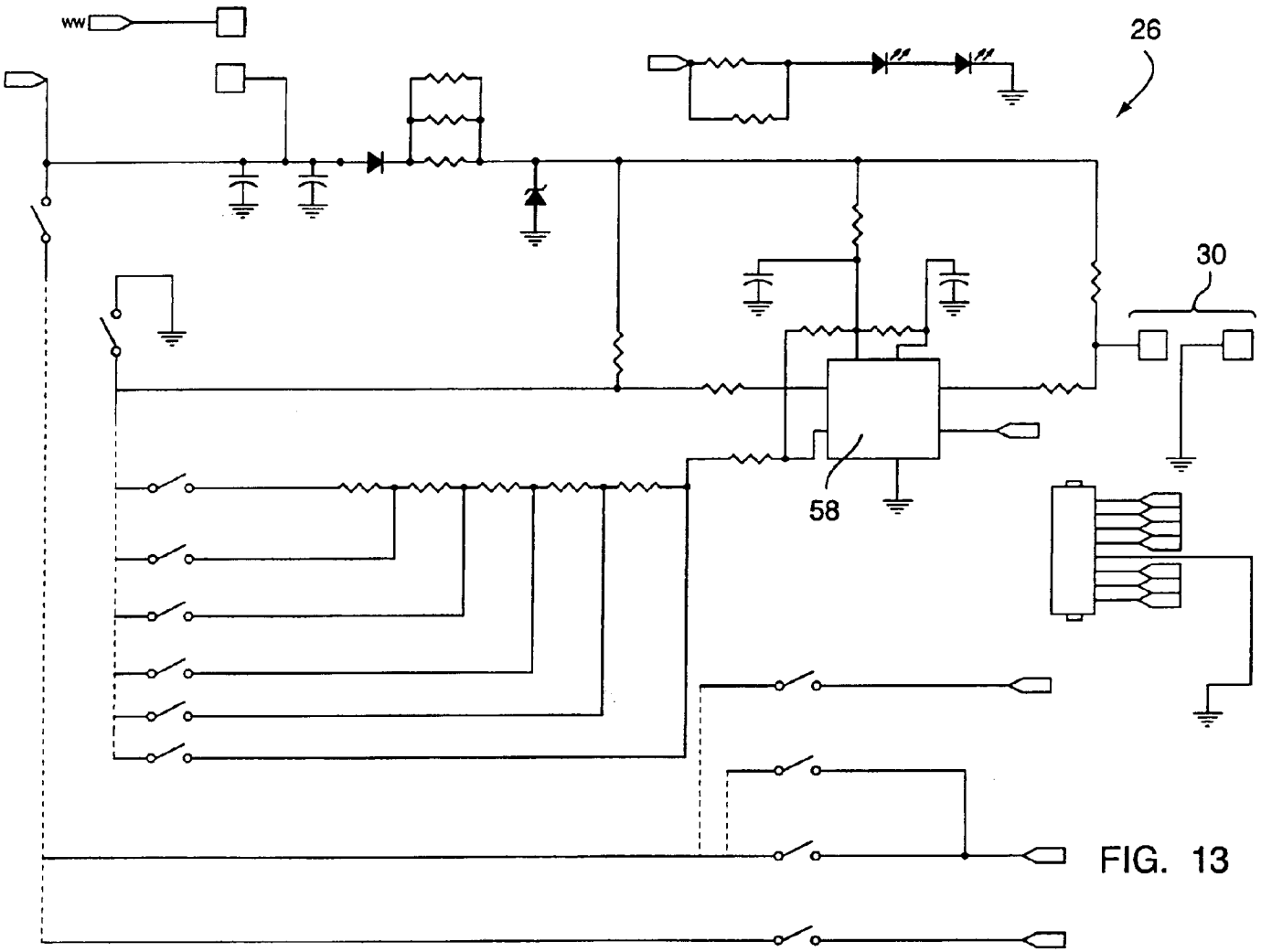
FIG. 13 is a schematic of the circuit board of one embodiment of the present invention.

FIG. 13 is a schematic of the circuit board 26 of an embodiment of the switch 10 configured to control windshield wipers using the toggle function of the switch and a windshield washer pump using the rocker function of the switch. The circuit board 26 includes an electronic device 58 for providing standard outputs common for controlling windshield wipers including outputs required for intermittent and delay features and the like. Alternatively, the device 58 can be configured so that the switch 10 is arranged to control equipment other than windshield wipers.

Figure 14:
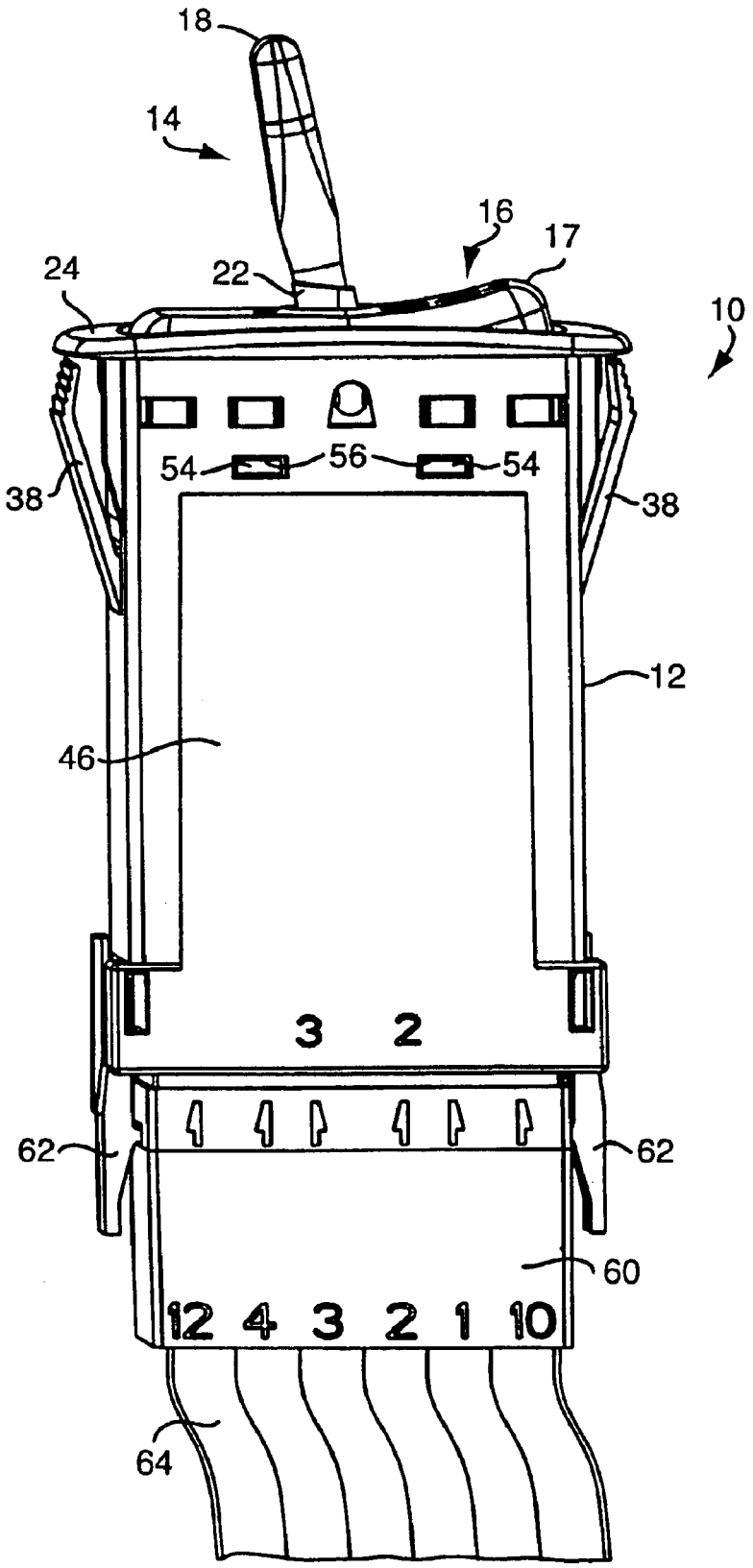
FIG. 14 is a perspective view of another embodiment of a switch according to the present invention shown with a connector coupled to the switch.
Figure 15:
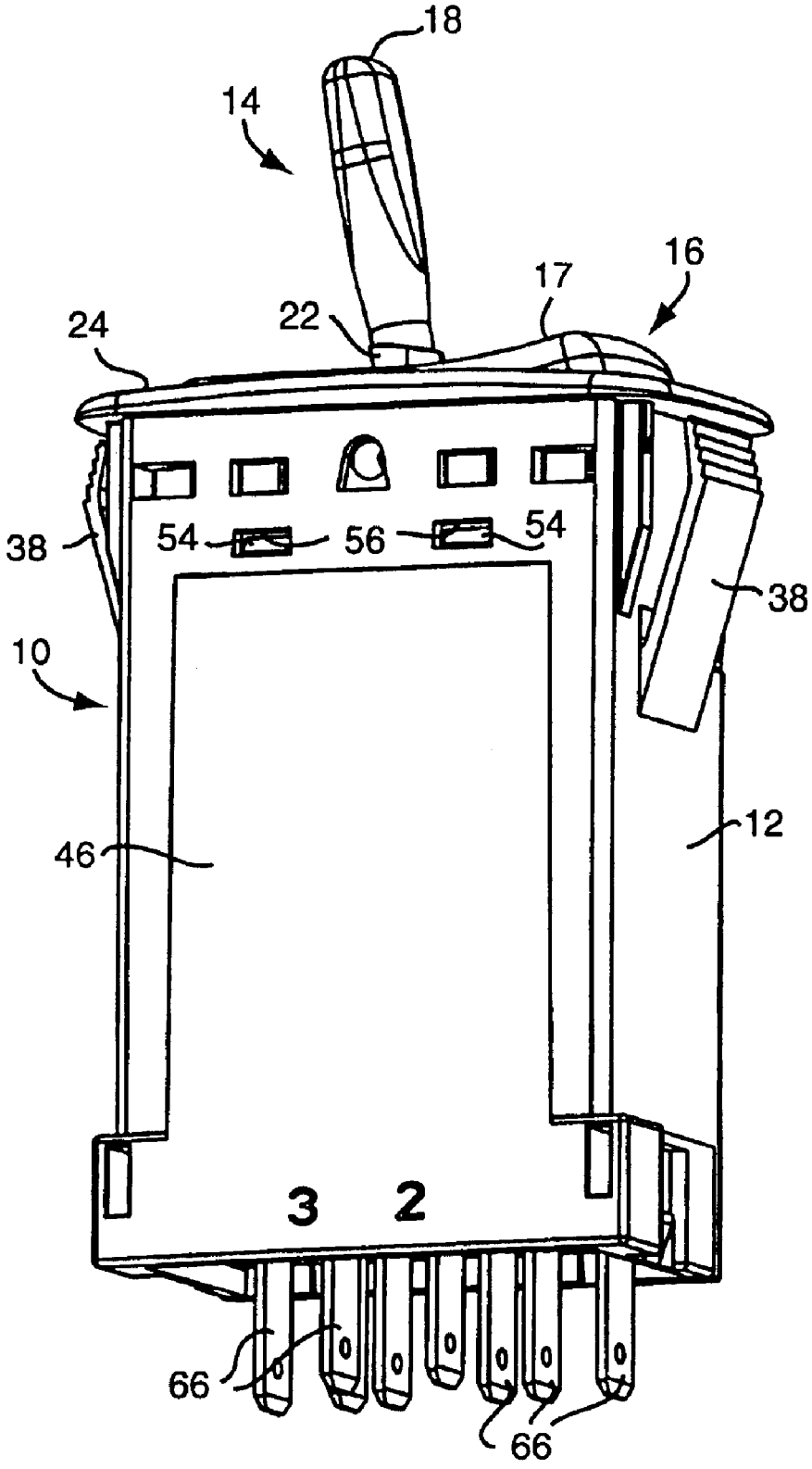
FIG. 15 is a perspective view of the switch of FIG. 14 shown without the connector.
Figure 16:
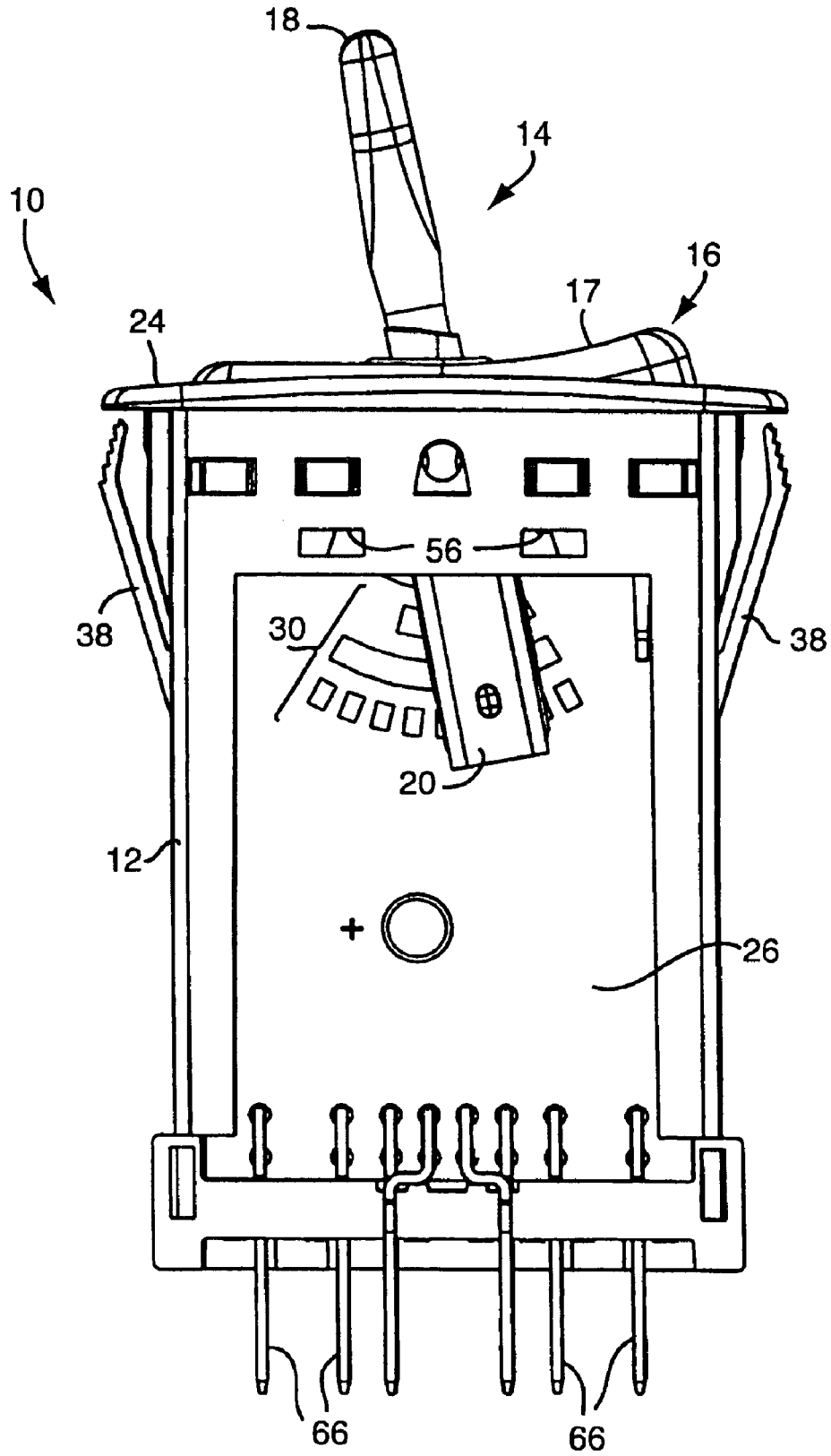
FIG. 16 is a perspective view of the switch of FIG. 14 shown without the rear wall of the housing.

An alternate embodiment of the switch 10 according to the present invention is shown in FIGS. 14–16 wherein a connector 60 is coupled to the housing 12 via a pair of latch members 62 for electrically coupling the switch to a wiring harness 64. The connector 60 defines a female portion (not shown) for engaging the terminals 66 that are connected to the circuit board 26 and extend outwardly from the housing 12. FIG. 16 shows the switch 10 without the side panel 46. The terminals 66 are coupled to the circuit board 26 and extend beyond the housing 12. Alternatively, the terminals 60 can be connected directly to another circuit board (not shown) or otherwise used to connect the switch 10 to an electrical circuit.

Figure 17:
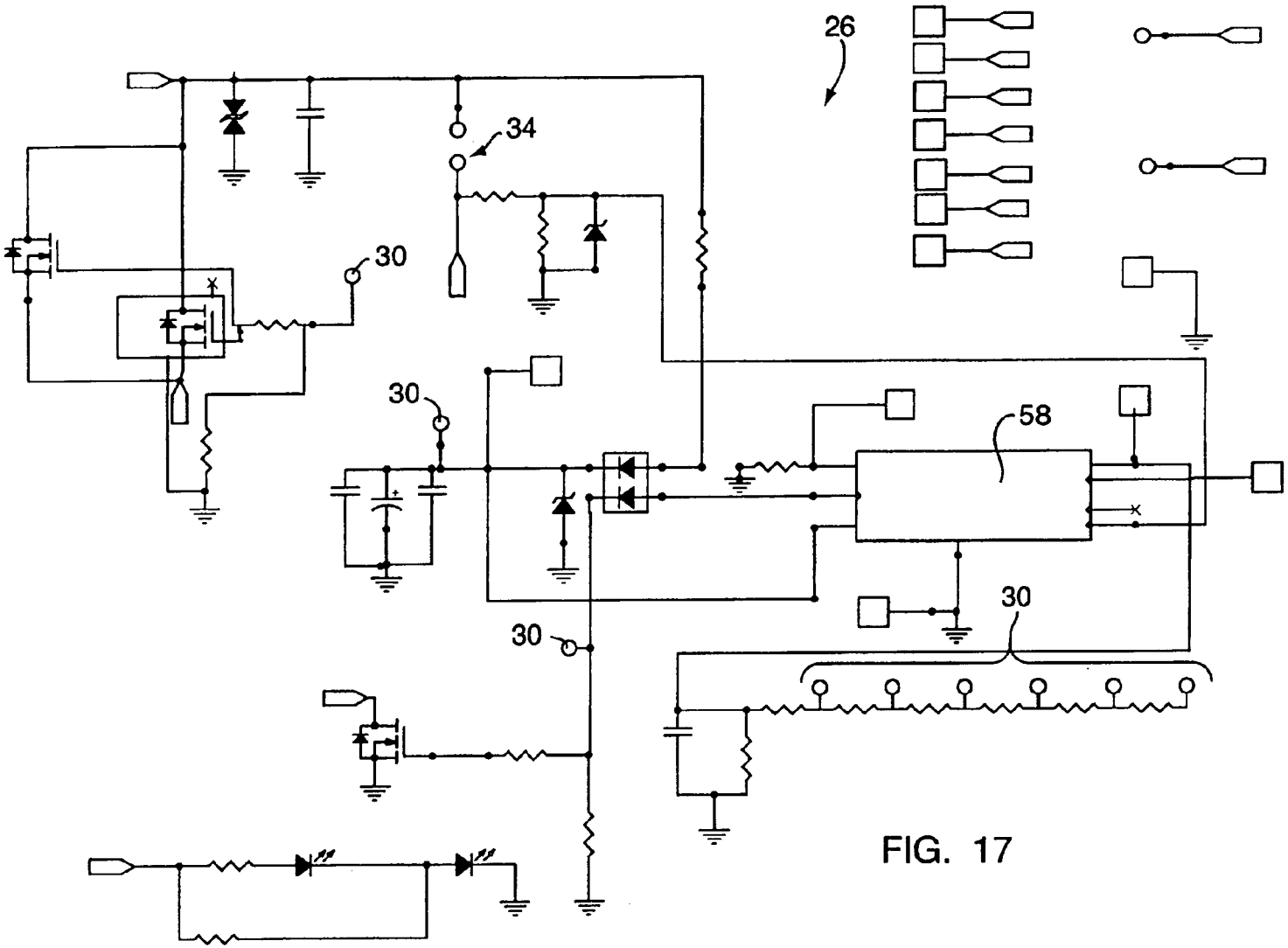
FIG. 17 is a schematic of another embodiment of the circuit board of the present invention switch.

FIG. 17 is a schematic of another embodiment of the circuit board 26 configured for use with the switch 10 for controlling windshield wipers and a windshield washer pump. In the FIG. 17, embodiment the circuit board 26 and switch 10 are rated to carry a current of 8 amperes at 13 Volts D.C. The circuit board 26 includes an electronic device 58 for providing standard outputs common for controlling windshield wipers including outputs suitable for intermittent and delay features and the like.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. An electrical switch having independently operable toggle and rocker functions, said switch comprising:

a housing, a toggle member mounted in said housing, said toggle member being manually movable to provide a toggle function of said switch, at least one first contact element coupled to said toggle member, a rocker member coupled to said housing for motion relative thereto and providing a rocker function of said switch, said rocker member defining a central opening for receiving said toggle member, a second contact element coupled to said rocker member, connector means disposed within said housing and cooperative with said first and second contact elements for selectively connecting said first and second contact elements to a circuit, and wherein said toggle member and said rocker member of said switch are independently operable for selectively connecting said first and second contact elements with said connector means for providing said toggle function and said rocker function of said switch respectively.

2. A switch as defined in claim 1 wherein said connector means includes a circuit board disposed in said housing.

3. A switch as defined in claim 2 further comprising at least one terminal coupled to said circuit board.

4. A switch as defined in claim 2 wherein said connector means includes a coupler connected to said circuit board for electrically connecting said circuit board to an electrical circuit.

5. A switch as defined in claim 2 wherein said circuit board further comprises an electronic device.

6. A switch as defined in claim 2 wherein said circuit board defines a first conductive portion disposed adjacent the first contact element for cooperation therewith and a second conductive portion disposed adjacent the second contact element for cooperation therewith and wherein the toggle function includes a plurality of switch conditions for various configurations of said connection between said first contact element and said first conductive portion of said circuit board.

7. A switch as defined in claim 6 wherein said first contact element includes at least one dumbbell shaped contact element.

8. A switch as defined in claim 6 wherein a portion of said rocker member seals the housing of said switch.

9. A switch as defined in claim 6 wherein said rocker member further comprises a resiliently deformable actuator for controlling said rocker function of said switch.

10. A switch as defined in claim 1 wherein said rocker member further comprises a flexible portion covering said central opening therein and sealed about said upper portion of said toggle member.

11. A switch as defined in claim 10 wherein said flexible portion of said rocker member is elastomeric.

12. A switch as defined in claim 1 wherein said rocker member seals the housing from the environment.

13. A switch as defined in claim 1 wherein said housing has a bezel surrounding both said toggle member and said rocker member of said switch.

14. A switch as defined in claim 1 wherein said housing further comprises at least one flexible wing member for mounting said switch in a panel.

15. A switch as defined in claim 1 wherein said connector means includes a connective portion accessible externally of said housing.

16. A switch as defined in claim 1 wherein said housing has a portion that includes a detent defining at least one position for said toggle member, said lower portion of said toggle member having a shoulder for engaging said detent defining housing portion.

17. A switch as defined in claim 1 wherein said first contact element includes at least one dumbbell shaped contact element.

18. A switch as defined in claim 1 wherein said toggle function is adapted to control a windshield wiper circuit and said rocker function is adapted to control a windshield washer circuit in a vehicle.

19. A switch as defined in claim 1 further comprising an illumination source for illuminating a portion thereof.

20. A switch as defined in claim 1 wherein said housing further comprises a bottom wall, said bottom wall defining an opening for receiving at least a portion of said connector means, said connector means having a connective portion accessible externally said housing.

* * * * *